US006540480B2

(12) United States Patent
Nikpour

(10) Patent No.: US 6,540,480 B2
(45) Date of Patent: Apr. 1, 2003

(54) COMPRESSOR

(75) Inventor: Bahram Nikpour, Huddersfield (GB)

(73) Assignee: Holset Engineering Company, Ltd., Huddersfield (GB)

( * ) Notice: Subject to any disclaimer, the term of this patent is extended or adjusted under 35 U.S.C. 154(b) by 0 days.

(21) Appl. No.: 09/790,845

(22) Filed: Feb. 22, 2001

(65) Prior Publication Data

US 2002/0012586 A1 Jan. 31, 2002

(30) Foreign Application Priority Data

Feb. 23, 2000 (GB) ..... 0004140

(51) Int. Cl.[7] ..... F04D 29/44
(52) U.S. Cl. ..... 415/206
(58) Field of Search ..... 415/204, 206, 415/173.1, 119, 914, 58.2, 58.3, 58.4, 58.6

(56) References Cited

U.S. PATENT DOCUMENTS

| | | | | |
|---|---|---|---|---|
| 3,901,620 A | * | 8/1975 | Boyce | 415/1 |
| 4,063,848 A | | 12/1977 | Wiggins et al. | 415/206 |
| 4,212,585 A | * | 7/1980 | Swarden et al. | 415/198.1 |
| 4,257,733 A | | 3/1981 | Bandukwalla et al. | 415/13 |
| 4,371,313 A | | 2/1983 | Burgbacher et al. | 415/215 |
| 4,504,188 A | | 3/1985 | Traver et al. | 415/1 |
| 4,770,603 A | | 9/1988 | Engels et al. | 415/147 |
| 5,137,419 A | * | 8/1992 | Waterman | 415/170.1 |
| 5,246,335 A | | 9/1993 | Mitsubori et al. | 415/58.3 |
| 5,497,615 A | | 3/1996 | Noe et al. | 60/39.511 |

FOREIGN PATENT DOCUMENTS

| | | |
|---|---|---|
| EP | 0 046 173 | 6/1981 |
| EP | 0 076 668 | 10/1982 |
| GB | 1 514 598 | 3/1976 |
| JP | 8074791 | 3/1996 |

* cited by examiner

*Primary Examiner*—Edward K. Look
*Assistant Examiner*—Richard A. Edgar
(74) *Attorney, Agent, or Firm*—Gary M. Gron

(57) ABSTRACT

A compressor comprises a housing (4, 5) defining an inlet (6) and an outlet (15, 7), and a compressor wheel (8) mounted for rotation about a shaft (9*a*) within a chamber defined by the housing between the inlet (6) and the outlet (7). The back of the compressor wheel (8) is set into a recess (16) defined by a wall of said housing (4), the outside diameter of the recess (16) being greater than the outside diameter of the recessed portion (10) of the compressor wheel (8) defining an annular clearance gap around the recessed portion of the compressor wheel (8). The outside diameter of the recess (16) is at least 1.05 times the outside diameter of the recessed portion of the compressor wheel and/or the depth of the recess in the region of said gap is greater than 1.5 times the axial width of the recessed portion of the compressor wheel.

10 Claims, 5 Drawing Sheets

COMPRESSOR

FIELD OF THE INVENTION

The present invention relates to a centrifugal compressor and particularly, but not exclusively, to a turbocharger centrifugal compressor.

BACKGROUND OF THE INVENTION

Turbochargers are well known devices for supplying air to the intake of an internal combustion engine at pressures above atmospheric (boost pressures), and are widely used in automobiles, powered boats and the like. A conventional turbocharger essentially comprises an exhaust gas driven turbine wheel mounted on a rotatable shaft within a turbine housing. For instance, in a centripetal turbine the turbine housing defines an annular inlet passage way around the turbine wheel and generally cylindrical axial outlet passageway extending from the turbine wheel. Rotation of the turbine wheel rotates a compressor wheel mounted on the other end of the shaft within a compressor housing. The compressor wheel delivers compressed air to the intake manifold of the engine, thereby increasing engine power.

All centrifugal compressors are subject to surge under low flow conditions, i.e. a condition of unstable operation in which large fluctuations in pressure and mass flow rate occur. In many cases, such as when the compressor is part of a turbocharger supplying air to a reciprocating internal combustion engine, the fluctuations in mass flow rate are unacceptable. Accordingly, much effort has been made to improve the surge margin of centrifugal compressors to improve the usable flow range of the compressor.

Map width enhanced compressors are known which seek to improve both surge and choke margins (the "map" of a compressor is the term given to a plot of total pressure ratio across the compressor against mass flow through the compressor, the width of the map being defined between the surge and choke flow limits). In a conventional map width enhanced compressor a chamber adjacent the compressor inlet is separated from the outer periphery of the compressor wheel vanes by a wall provided with an annular slot, or a series of radial holes, which allows communication between the chamber and the compressor wheel. This communication increases the amount of gas reaching the compressor wheel during high flow and high RPM operation and re-circulates gas to the compressor inlet during low flow operation, stabilising the compressor at choke and surge speeds respectively.

While such measures have been shown to be effective the present invention seeks to improve the surge margin of compressors yet further.

SUMMARY OF THE INVENTION

According to the present invention there is provided a compressor comprising a housing defining an inlet and an outlet, and a compressor wheel mounted for rotation about an axis within a chamber defined by the housing between the inlet and the outlet, the front of the compressor wheel facing said inlet and a portion of the back of the compressor wheel being set into a recess defined by a wall of said housing, said compressor wheel having a plurality of blades extending from the front side of said compressor wheel, the outside diameter of the recess being greater than the outside diameter of the recessed portion of the compressor wheel defining an annular clearance gap around the recessed portion of the compressor wheel, wherein the outside diameter of the recess is at least 1.05 times the outside diameter of the recessed portion of the compressor wheel and/or the depth of the recess in the region of said gap is greater than 1.5 times the axial width of the recessed portion of the compressor wheel.

In accordance with the invention the recess can be enlarged either radially or axially (in the region of the compressor wheel blade tips), or both. The enlargement to the recess provides the site for formation of the vortex mentioned above. The typical enlargement of the diameter of the recess will be between 1.05 and 1.15 times the outside diameter of the recessed portion of the compressor wheel. Test have shown that improvements in the surge margin are evident for a recess at least 1.05 times the diameter of the recessed part of the compressor wheel (typically the wheel back plate) and increase as the recess enlargement increases. However, loss of performance offsets the gain in surge margin for recesses made much more than about 1.15 times the diameter of the wheel. The preferred enlargement range is 1.10 to 1.12 times the diameter of the wheel In embodiments in which the depth of the recess is increased this can be achieved by machining a groove within the recess adjacent the periphery of the recessed part of the wheel.

Other preferred features of the invention will be apparent from the following description of various different embodiments of the invention.

BRIEF DESCRIPTION OF THE DRAWINGS

Specific embodiments of the present invention will now be described, by way of example only, with reference to the accompanying drawings, in which.

DETAILED DESCRIPTION OF THE PREFERRED EMBODIMENTS

Figure 1:
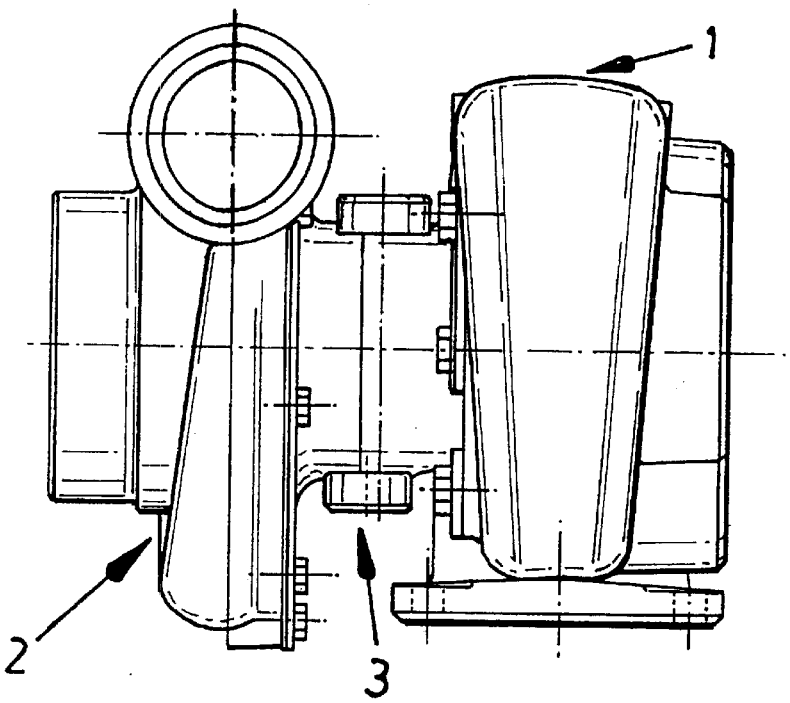
FIG. 1 (PRIOR ART)
FIG. 1 is a external view illustrating the major components of a conventional turbocharger.

Referring to the drawings, FIGS. 1 and 2 illustrate a conventional centrifugal type turbocharger comprising a turbine indicated generally by the reference numeral 1, a compressor indicated generally by the reference numeral 2, and a central bearing housing indicated by the reference numeral 3.

Figure 2A:
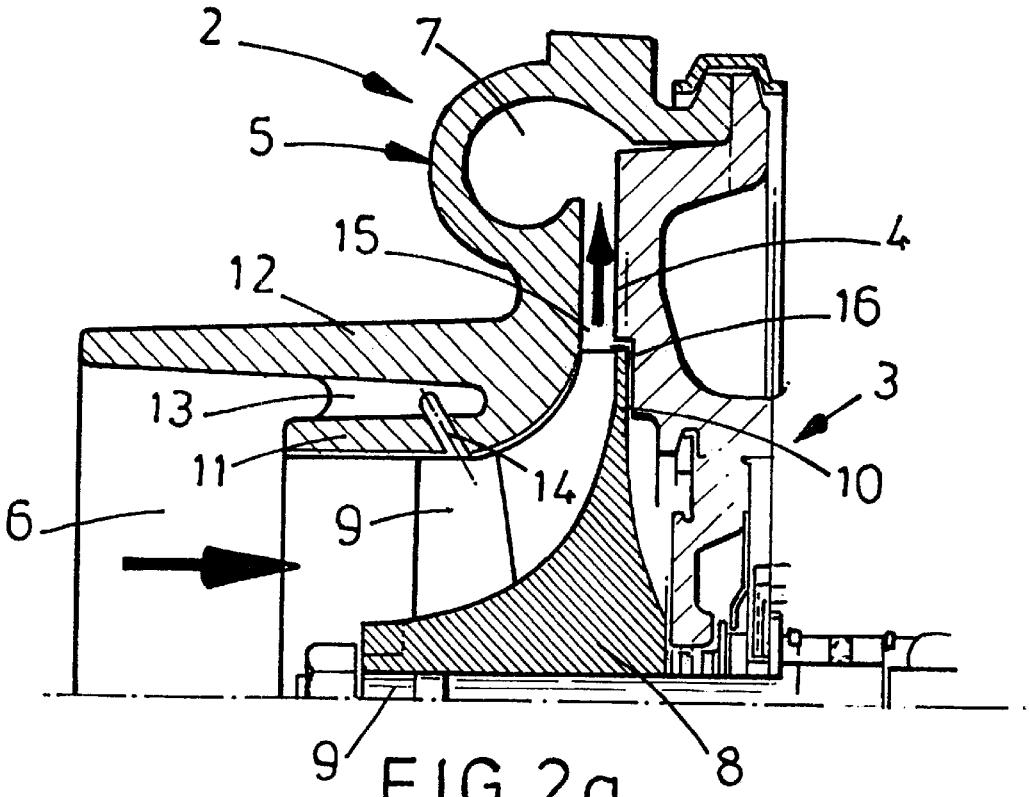
FIG. 2a (PRIOR ART)
FIG. 2*a* is a cross-section through a part of the turbocharger of FIG. 1 showing details of the compressor.

FIG. 2*a* shows a cross-section through part of the compressor section of the turbocharger of FIG. 1 from which it can be seen that the compressor comprises a housing defined in part by a diffuser section 4 which is part of the bearing housing casting 3 and a compressor cover 5 which defines an inlet 6 and an outlet volute 7. An annular imperforate compressor wheel 8 is mounted for rotation about a shaft 9*a* which extends through the bearing housing 3 to the turbine 1. The compressor wheel 8 comprises an array of blades 9 supported by a back disc 10 which is recessed into the diffuser section 4.

The illustrated compressor is of a map width enhanced type in which the inlet 6 comprises a tubular inlet portion 11 around which extends a tubular intake portion 12 defining an annular chamber 13 therebetween. An annular slot 14 is formed through the tubular inlet portion 11 so that the chamber 13 communicates with an inducer portion of the compressor housing swept by the compressor blades 9. The outlet to the compressor volute 7 is via a diffuser passage 15, defined between the compressor cover 5 and diffuser section 4 of the bearing housing 3, which is an annular passage surrounding the tips of the compressor blades 9. In the discussion that follows, the character ØD is used to designate the various diameters. The character Ø is commonly used to indicate a diameter on an engineering drawing.

Figure 2B:
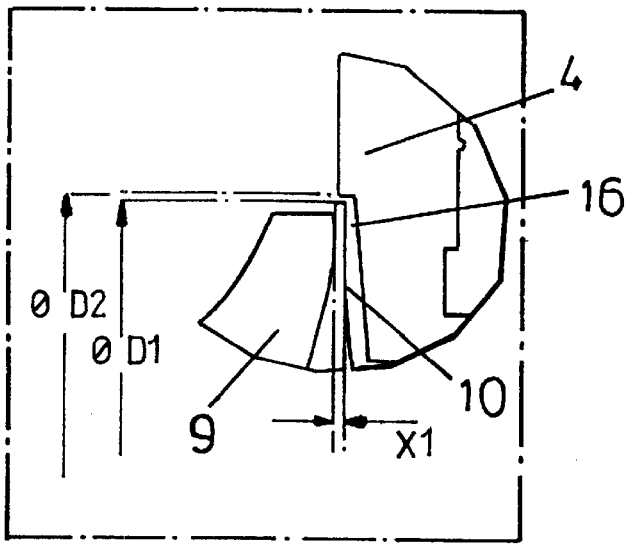
FIG. 2b (PRIOR ART)
FIG. 2*b* is an enlarged view of a detail of FIG. 2*a* illustrating the recess within which the compressor wheel rotates.

FIG. 2*b* is an enlargement of part of FIG. 2*a* showing more clearly the recess 16 in the housing within which the compressor wheel back disc 10 is recessed. In a conventional turbocharger such as that illustrated the recess is machined into the housing to leave the minimum necessary annular gap around the outside diameter ØD1 of the wheel 8 (in this case the diameter of the back disc 10) to provide clearance for rotation of the compressor wheel 8. As such, the diameter ØD2 of the recess 16 is typically somewhere between 1.01 and 1.04 times the outside diameter ØD1 of the recessed portion of compressor wheel, which in the illustrated example is the diameter of the back disc 10.

Figure 3:
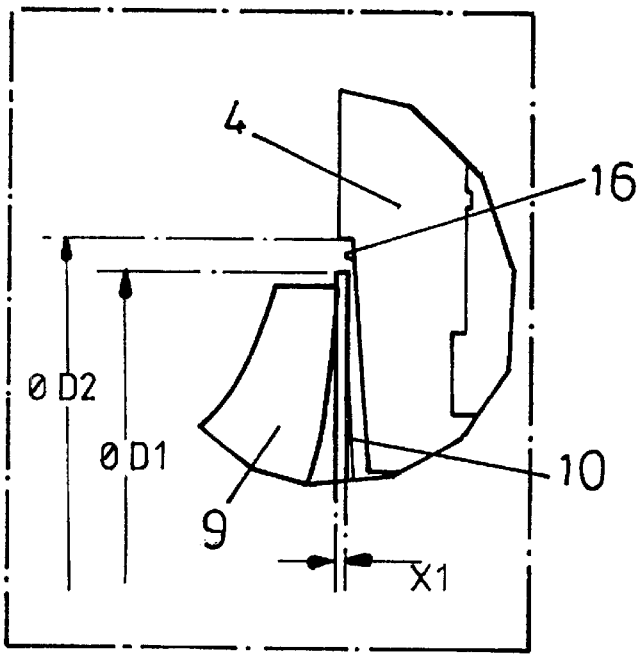
FIG. 3 illustrates a modification of the turbocharger of FIGS. 1 and 2 to enlarge the compressor recess in accordance with a first embodiment of the present invention.

Referring now to FIG. 3, this illustrates a first modification of the recess 16 in accordance with embodiment of the present invention. FIG. 3 is a view corresponding to FIG. 2*b* illustrating provision of an enlarged compressor wheel recess 16 compared with that of the conventional turbocharger illustrated in FIG. 2*b*. With this embodiment the recess is enlarged radially although is of substantially the same depth as the recess of FIG. 2*b*. In the illustrated example the diameter ØD2 of the recess is 1.05 times the diameter ØD1 of the recessed portion of the wheel 8 (i.e. back disc 10).

Figures 4A, 4B:
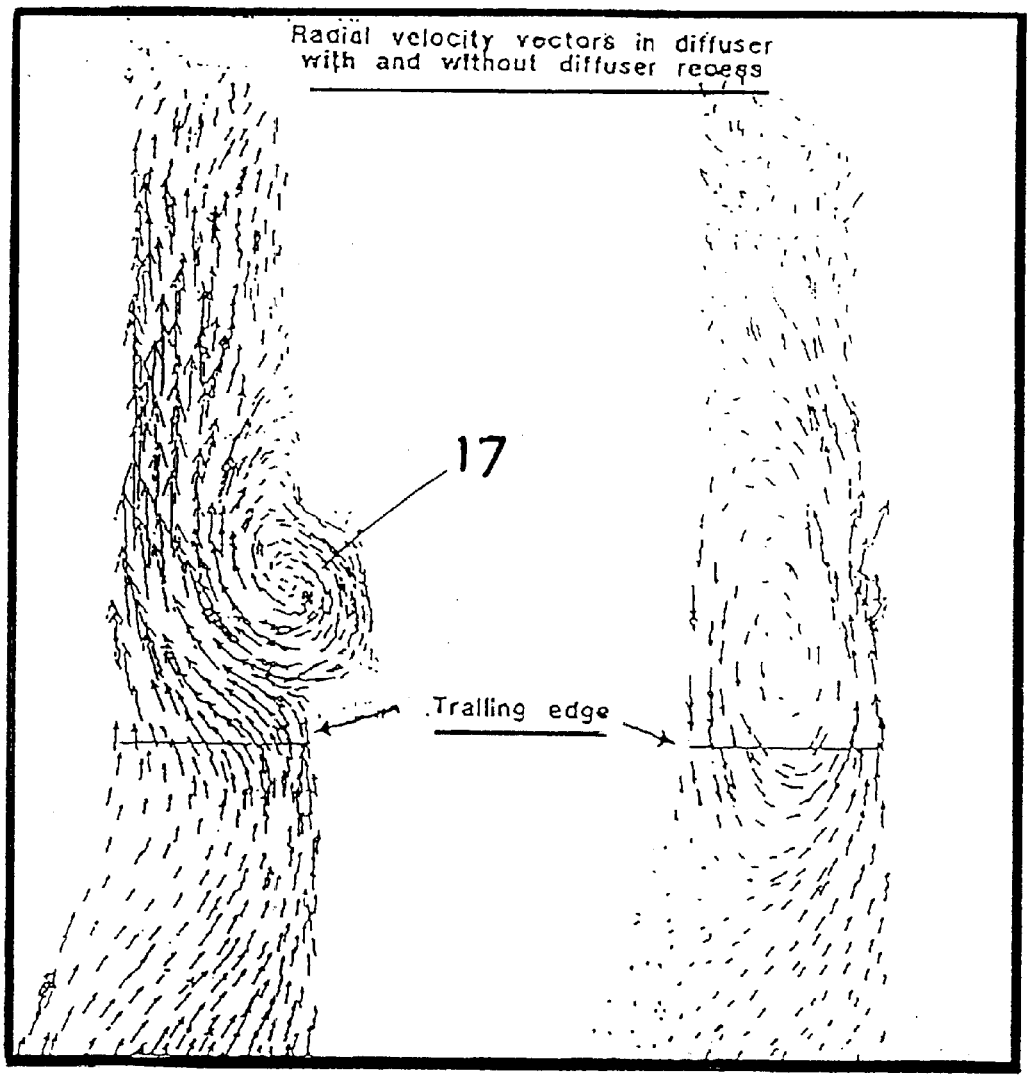
FIGS. 4*a* and 4*b* illustrate sample CFD (Computational Fluid Dynamics) results contrasting the conventional compressor of FIGS. 1 and 2 with the modified compressor of FIG. 3 at surge conditions.
Figure 5:
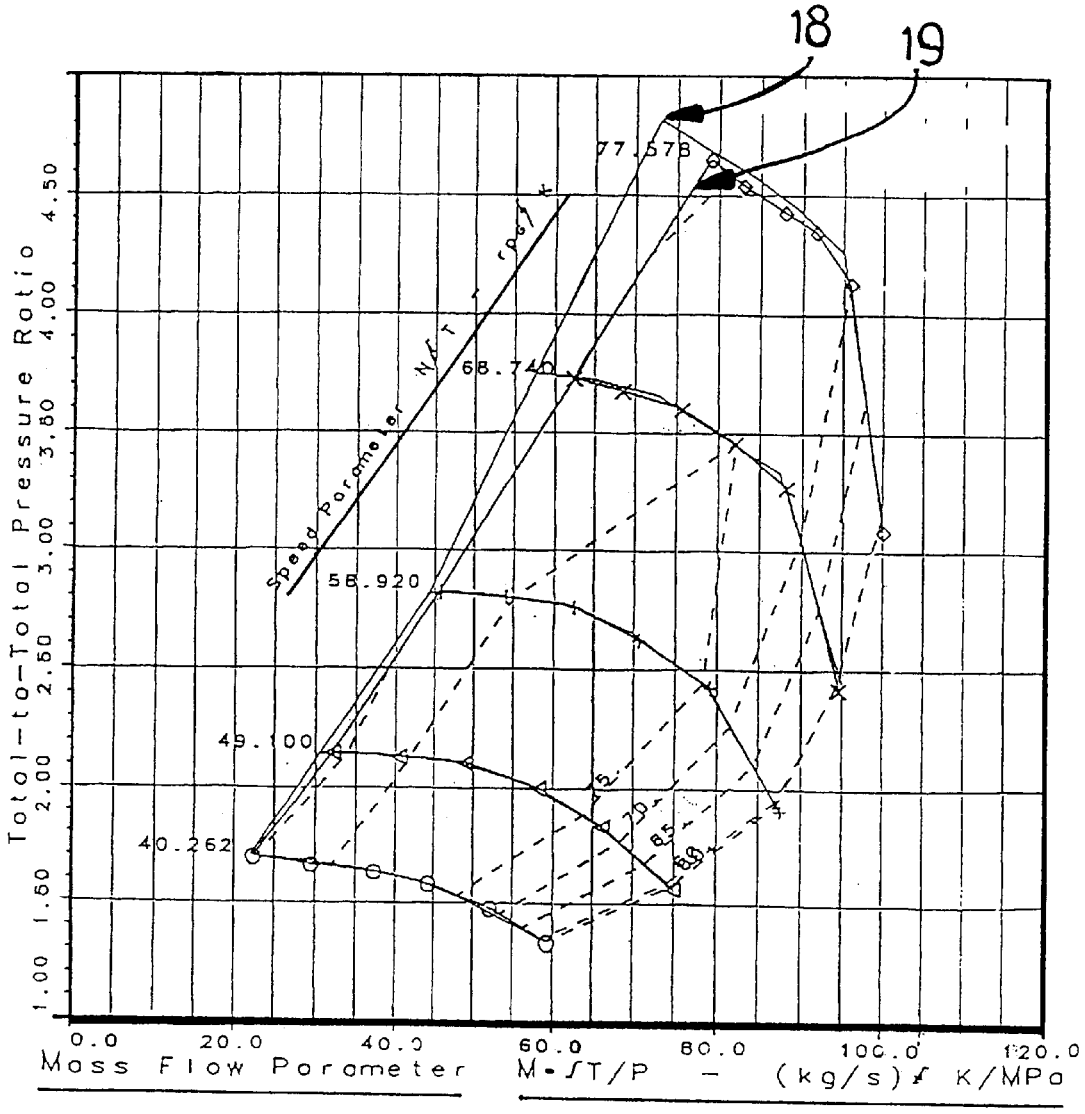
FIG. 5 is a plot of the total pressure ratio against air flow (i.e. compressor map) illustrating the improvement to the surge margin provided by the modification illustrated in FIG. 3.

FIGS. 4*a* and 4*b* respectively show CFD results for the compressor geometries illustrated in FIGS. 2*a* and 3 at near surge operation. From this it can be seen that with the geometry according to the present invention a vortex 17 is formed in the region of the enlarged recess 16 surrounding the compressor wheel 8. This vortex 17 effectively acts as an aerodynamic "pinch" to the diffuser reducing the size of the diffuser at near surge operation which effectively delays the onset of surge. The improvement in the surge margin is evident from comparison of the compressor maps for each of the two geometries as illustrated in FIG. 5. This shows that the surge line 18 of the modified geometry is displaced to the left in comparison with the surge line 19 of the unmodified geometry of FIG. 2*b*. The effect is particularly pronounced at relatively high pressure ratios (above about 3:1) where up to 15% additional surge margin is obtained.

Tests have shown that the vortex 17 which produces the aerodynamic pinch forms at surge conditions but disappears at higher flow rates and thus does not produce the performance loss that is generally associated with mechanical restrictions which can be built into the diffuser to improve surge margin. In other words, the modification in accordance with the present invention improves the surge margin without detracting from the efficiency of the compressor across its working range.

One of the reasons why conventional compressor wheel recesses are machined to a close tolerance, thus minimising the annular gap formed by the recess around the compressor wheel, is to avoid perceived problems with oil leakage. That is, it has generally been considered within the art that an increase in the recess size would reduce the pressure behind the compressor wheel and increase the likelihood of oil, leakage from the bearing housing. The present inventors have shown that this is not the case and in fact small pressure increases behind the compressor wheel have been measured as a result of the increase in the size of the compressor wheel recess so that oil leakage does not pose a problem.

Figure 6:
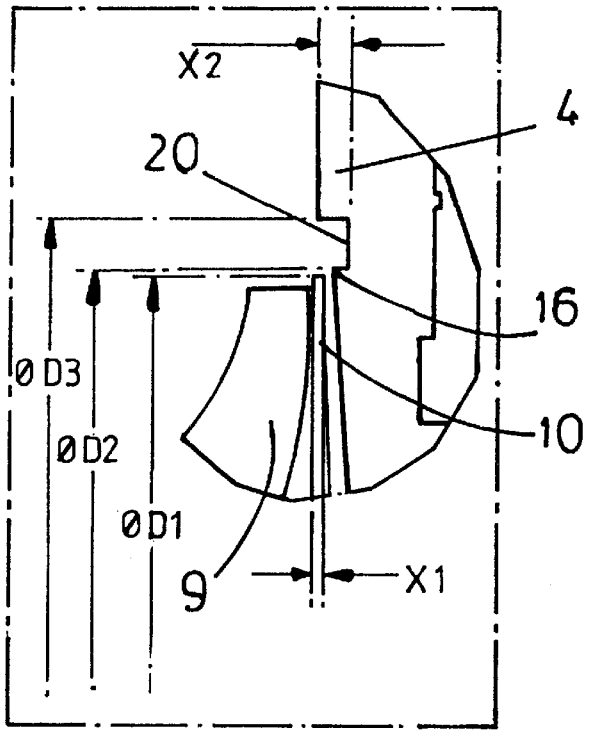
FIGS. 6 and 7 illustrate further embodiments of the present invention.

FIG. 6 illustrates an alternative embodiment of the present invention in which an annular groove 20 is formed within the compressor recess 16 in the region of the annular gap defined between the outside diameter ØD1 of the recessed part of the compressor wheel and the outside diameter ØD3 of the recess. In a typical conventional turbocharger the depth of the recess in this region is of the order of 1.2 times the axial width of recessed portion of the compressor wheel, (typically the back disc 10). In accordance with this embodiment of the present invention the depth ×2 is increased to greater than 1.5 times the axial width ×1 of the recessed portion of the compressor wheel. Tests have shown that this provides an improvement in the surge margin even if the diameter of the recess is not increased. It will however be appreciated that the increased recess depth can be combined with an increase in the recess diameter to enhance the effect. Again the improvement to the surge margin is due to the formation of a vortex within the recess around the compressor wheel at surge flow rates.

Figure 7:
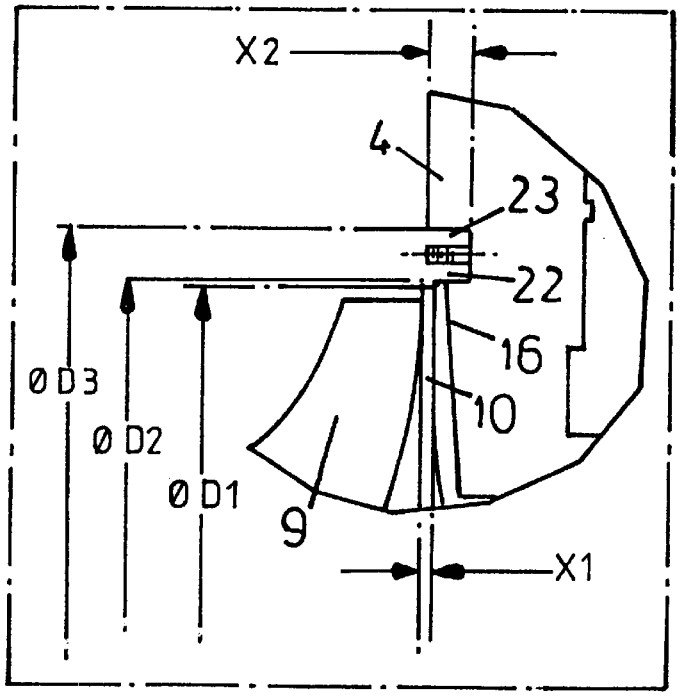

FIG. 7, shows an embodiment of the present invention in which a first groove 22 is provided within the compressor recess 16 and a second groove 23 is provided around the compressor recess which is effectively the same as providing an annular partition within the groove of the embodiment of FIG. 6.

Tests have shown that provision of an enlarged compressor wheel recess communicating with the wheel provides a site for formation of a vortex in the compressor wheel outlet (diffuser) near surge conditions which effectively forms an aerodynamic restriction in the outlet improving the surge margin of the compressor. The vortex, however, disappears at higher flow rates and thus there is no performance loss across the operational range of the compressor which would be expected if a fixed physical restriction is provided.

Tests have also shown that the improvement in the surge margin is particularly significant at relatively high pressure ratios. This is particularly an advantage where the compressor is incorporated in turbochargers since increasingly stringent emissions regulations are leading engine manufacturers to require turbochargers (and thus compressors) which operate at higher boost pressures.

It will be appreciated that many modifications could be made to the detailed embodiments of the invention described above. Testing will reveal how the effect provided by the present invention can be optimised for any particular application. The important feature of the invention is that a site is provided within the compressor housing for formation of the vortex illustrated in FIG. 4*b*, that site being provided by enlarging a part of the recess within which the compressor wheel rotates.

It will be appreciated that the invention can be applied to different designs of compressor and compressor wheel. For instance, the compressor wheel may be recessed to a greater or lesser extent than that illustrated and may have blades configured considerably differently from those illustrated. For instance, although in the above example the diameter of the back disc is greater than the outside diameter of the blade tips, this need not necessarily be the case. The blades and back disc could for example have the same outside diameter. Similarly, the compressor wheel housing may be considerably different from that illustrated and for instance may comprise a single casting which is bolted to the bearing housing rather than being comprised jointly of the compressor cover and bearing housing. In addition, whereas the particular compressor illustrated is a map width enhanced compressor design this need not necessarily be the case. Similarly, the compressor illustrated is a vaneless design but the invention could equally be applied to the compressor provided with vanes within the diffuser.

Other possible modifications will be readily apparent to the appropriately skilled person.

Having thus described the invention, what is claimed as novel and desired to be secured by Letters Patent of the United States is:

1. A compressor comprising a housing defining an inlet and an outlet, and an annular imperforate compressor wheel having an outside diameter and mounted for rotation about an axis within a chamber defined by the housing between the inlet and the outlet, the front of the compressor wheel facing said inlet and a portion of the back of the compressor wheel being set into an annular recess defined by a wall of said housing, said compressor wheel having a plurality of blades extending from the front side of said compressor wheel, the outside diameter of the recess being greater than the outside diameter of the recessed portion of the compressor wheel defining an annular clearance gap around the recessed portion of the compressor wheel, wherein the outside diameter of the recess is at least 1.05 times the outside diameter of the recessed portion of the compressor wheel.

2. A compressor as claimed in claim 1, wherein the axial dimension of said annular recess within the region of the gap is greater than 1.1 times the axial width of the recessed portion of the compressor wheel.

3. A compressor as claimed in claim 2, wherein the depth of the annular recess is increased by provision of at least one annular groove within said recess at least part of which surrounds the outside diameter of the recessed portion of the compressor wheel.

4. A compressor as claimed in claim 3, wherein a pair of concentric annular grooves are provided in said housing.

5. A compressor as claimed in claim 1, wherein the outside diameter of the recess is between 1.05 and 1.15 times the outside diameter of the recessed portion of the compressor wheel.

6. A compressor as claimed in claim 1, wherein the outside diameter of the recess is between 1.1 and 1.15 times the outside diameter of the recessed portion of the compressor wheel.

7. A compressor as claimed in claim 1, wherein the outside diameter of the recess is between 1.1 and 1.12 times the outside diameter of the recessed portion of the compressor wheel.

8. A compressor as claimed in claim 1, wherein the outside diameter of the recess is between 1.05 and 1.12 times the outside diameter of the recessed portion of the compressor wheel.

9. A compressor housing defining an inlet and an outlet, and an annular imperforate compressor wheel having an outside diameter and mounted for rotation about an axis within a chamber defined by the housing between the inlet and the outlet, the front of the compressor wheel facing said inlet and a portion of the back of the compressor wheel being set into an annular recess defined by a wall of said housing, said compressor wheel having a plurality of blades extending from the front side of said compressor wheel, the outside diameter of the annular recess being greater than the outside diameter of the recessed portion of the compressor wheel defining an annular clearance gap around the recessed portion of the compressor wheel, wherein the axial dimension of the recess in the region of said gap is greater than 1.5 times the axial width of the recessed portion of the compressor wheel.

10. A compressor as claimed in claim 9, wherein the outside diameter of the annular recess is greater than 1.01 times the outside diameter of the recessed portion of the compressor wheel.

* * * * *